313-422
12/29/81 XR 4,308,484

United States Patent [19]
Carroll et al.

[11] 4,308,484
[45] Dec. 29, 1981

[54] FRONTPLATE AND SHADOW MASK ASSEMBLIES FOR A MODULAR FLAT PANEL DISPLAY DEVICE

[75] Inventors: Charles B. Carroll, Trenton; Robert E. Schneller, Bricktown, both of N.J.

[73] Assignee: RCA Corporation, New York, N.Y.

[21] Appl. No.: 113,044

[22] Filed: Jan. 17, 1980

[51] Int. Cl.[3] ..... H01J 29/07; H01J 29/86
[52] U.S. Cl. ..... 313/402; 313/403; 313/422
[58] Field of Search ..... 313/422, 402, 403, 407

[56] References Cited

U.S. PATENT DOCUMENTS

| | | | |
|---|---|---|---|
| 4,101,802 | 7/1978 | Andrevski | 313/422 |
| 4,103,205 | 7/1978 | Credelle | 313/422 |
| 4,145,633 | 3/1979 | Peters et al. | 313/422 |
| 4,259,611 | 3/1981 | Van Raalte | 313/422 |

*Primary Examiner*—Palmer C. Demeo
*Attorney, Agent, or Firm*—Eugene M. Whitacre; Glenn H. Bruestle; Lester L. Hallacher

[57] ABSTRACT

A faceplate assembly for a display device is composed of a shadow mask assembly and a frontplate assembly both of which can be individually assembled. The shadow mask assembly is composed of a plurality of vane tips positioned between a plurality of channel shaped shadow mask sections. Tie rods pass through the tips and tip spacers to hold the members together in a single assembly. The spacers are positioned inside the tip walls to control the transverse dimension of the shadow mask assembly. The frontplate assembly includes location blocks which are affixed to the frontplate in the proximity of the corners of the frontplate. Location notches are precisely located on the frontplate and the precise positions of the location blocks with respect to the location notches recorded. A shadow mask assembly and a frontplate assembly are mated and the shadow mask assembly precisely positioned by inserting shims of the required thicknesses between the location blocks and the mask assembly.

12 Claims, 5 Drawing Figures

FRONTPLATE AND SHADOW MASK ASSEMBLIES FOR A MODULAR FLAT PANEL DISPLAY DEVICE

BACKGROUND OF THE INVENTION

This invention relates generally to flat panel display devices and particularly to a faceplate assembly for such a device.

U.S. Pat. No. 4,145,633 discloses a modular flat panel display device in which shadow mask sections are supported between vanes which divide the display device into a plurality of channels. Positioned between the faceplate and the vanes are metallic vane tips which taper to a narrow edge at the faceplate side. The narrow edges of the vane tips rest against the faceplate and are substantially invisible through the faceplate because of the narrow line contact with the faceplate. A plurality of retainer clips are positioned along the vane tips to prevent the shadow mask sections from moving transversely in the channels.

U.S. Application Ser. No. 71,389 entitled "Faceplate Assembly For A Flat Panel Display Device" filed Aug. 30, 1979 by Victor Christiano, et al. discloses a modular flat panel display device which includes two rows of registration blocks which are arranged so that a block is present at each end of the propagation channels. The registration blocks contained within each row are fritted to the faceplate and the registration blocks are configured so that adjacent blocks cooperate to form vane tip guide slots. The registration blocks engage the shadow mask sections and support the shadow mask sections against transverse movement while permitting the longitudinal motion occasioned by thermal expansion. The shadow mask sections are channel shaped. Tie rods pass through the vane tips and the registration blocks to hold the components together in a single structure. Because the registration blocks are fritted to the faceplate, the components must be assembled directly to the faceplate and the registration blocks must be accurately fritted in the required positions.

U.S. Application Ser. No. 33,966 entitled "Modular Tube Shadow Mask Support System" filed Apr. 27, 1979 by John A. vanRaalte discloses a support system for a shadow mask assembly in a modular flat panel display device. Slotted insulating support members are fritted to the faceplate. The shadow mask sections are configured to closely fit into the slots so that the shadow mask sections are held against transverse movement with respect to the faceplate. The slots allow longitudinal movement so that the shadow mask sections are not deformed by thermal expansion. Retainer members are positioned on top of the slotted supports to retain the shadow mask sections within the slots. Additionally, biasing means are provided to retain the shadow mask sections in the desired position with respect to the slotted guide member.

SUMMARY OF THE INVENTION

In a modular flat panel display device the frontwall is provided with two precisely positioned reference notches. Locating blocks are arranged in the corners of the frontwall and their positions, with respect to the reference notches, are precisely determined. A shadow mask assembly is assembled using tie rods, vane tips, shadow mask sections and insulating spacers which accurately maintain the transverse dimension of the assembly. The completed shadow mask assembly is located with respect to the location blocks and affixed to the frontwall assembly, using the location blocks as mounting blocks. The positions of the locating blocks are accurately known and the shadow mask assembly, therefore, can be accurately positioned with respect to the location notches.

DETAILED DESCRIPTION OF THE PREFERRED EMBODIMENT

Figure 1:
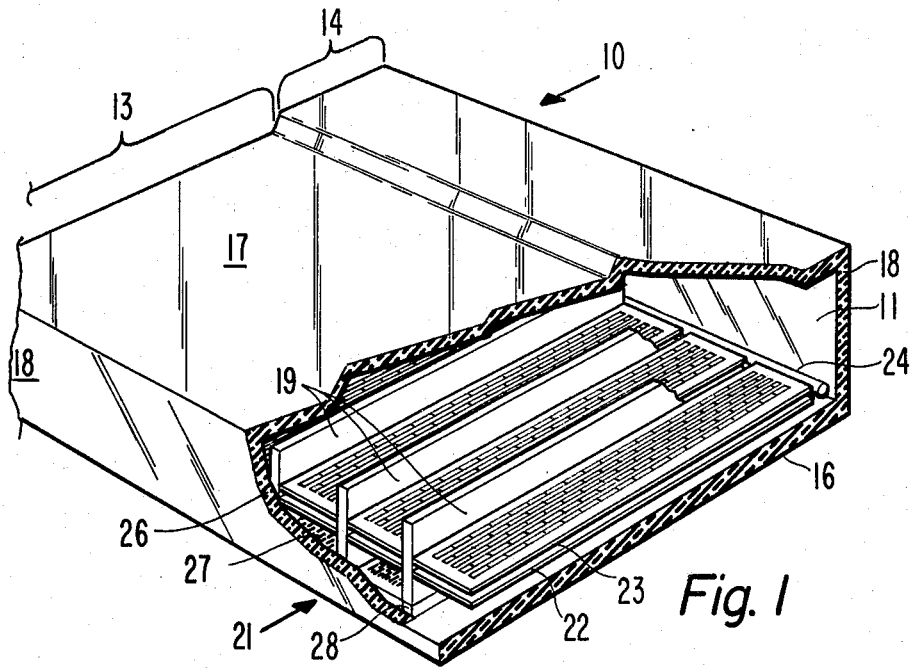
FIG. 1 is a perspective view partially broken away of a modular flat panel display device.

FIG. 1 shows one form of a flat panel display device in which the instant invention can be utilized. The display device is generally designated as 10 and includes an evacuated envelope 11 having a display section 13 and an electron gun section 14. The envelope 11 includes a rectangular frontwall 16 and a rectangular backwall 17 in spaced parallel relationship with the frontwall. The frontwall 16 and the backwall 17 are connected by four sidewalls 18.

A plurality of spaced parallel support vanes 19 are secured between the frontwall 16 and the backwall 17 and extend from the gun section 14 to the opposite sidewall 18. The support vanes 19 provide the desired internal support against external atmospheric pressure and divide the envelope 11 into a plurality of channels 21. Each of the channels 21 encloses a beam guide assembly for propagating electron beams along the channels 21. The beam guide assemblies include pairs of spaced parallel beam guide meshes 22 and 23 extending transversely across the channels and longitudinally along the channels from the gun section 14 to the opposite sidewall 18.

A line cathode 24 is arranged to emit electrons into the spaces between the beam guides. The inside surface of the frontwall 16 is provided with a phosphorus screen 26 which luminesces when impacted by electrons. The screen can be composed of three different phosphors arranged in a pattern, such as repeating triads of stripe-shaped elements, to produce a color visual output in response to electron excitation. Positioned between the guide mesh 22 and the frontwall 16 is a shadow mask section 27 which is used in a conventional manner to obtain color selection in a color display device. The shadow mask is supported by a plurality of vane tips 28 which are arranged between the vanes 19 and the frontwall 16. The vane tips and vanes are held in position by atmospheric pressure on the outer walls when the envelope is evacuated.

Figure 2:
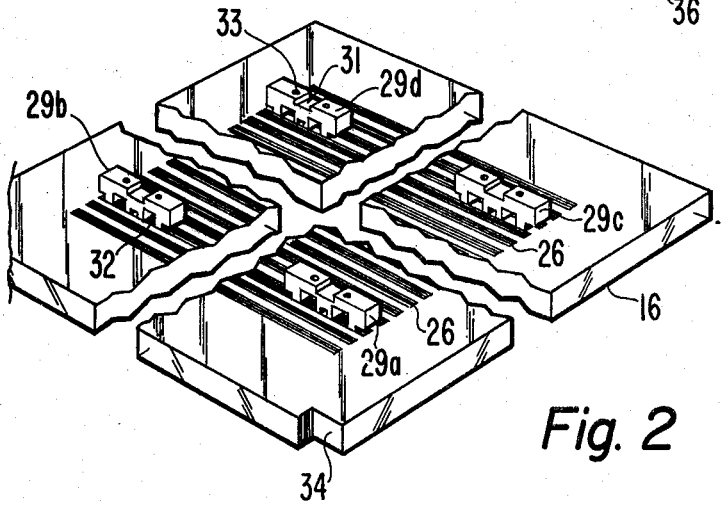
FIG. 2 is a perspective view partially broken away of the faceplate showing the reference notches and locating blocks.

FIG. 2 shows the frontplate 16 in greater detail. The frontplate 16 is shown broken away except for the four corners. Insulative location blocks 29*a*, 29*b*, 29*c* and 29*d* are fritted or otherwise fastened to the internal surface of the frontplate 16. Reference notches 34 are ground or otherwise formed in the frontplate 16. The desired positions of the four location blocks, with respect to the reference notches, are precisely known and the blocks are accurately, but not precisely, placed in the desired positions, as an example an accuracy of ±0.01 inches is permissible. After the location blocks are affixed to the surface of the frontplate 16 the exact positions of the blocks, with respect to the reference notches 34 are accurately measured and recorded. Accordingly, the precise positions of the location blocks are known, but it is not necessary to precisely position the blocks on the frontplate.

The location blocks 29*a* to 29*d* contain slots 31 which are used to position the shadow mask assembly between the location blocks. The location blocks also contain bottom notches 32, which receive clamping nuts, or other fastening means, to secure the shadow mask assembly to the frontplate.

FIG. 2 also shows the phosphor screen 26 disposed between the location blocks 29*a* through 29*d*. The phosphor stripes of the screen and the channels 21 extend parallel to a line connecting the location blocks 29*a* and 29*b*.

Figure 3:
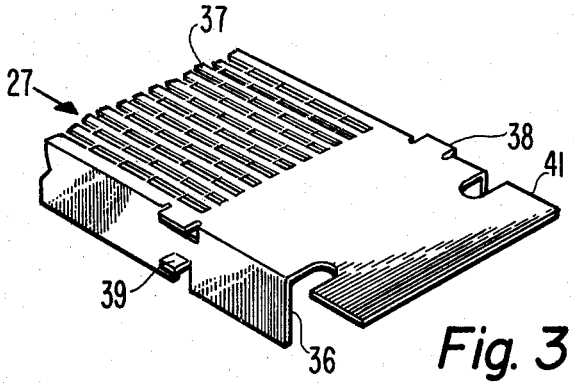
FIG. 3 is a perspective view of a portion of a shadow mask section.

FIG. 3 shows a portion of one of the shadow mask sections 27. The shadow mask section 27 is bent into a channel shaped member to include two sidewalls 36 and a multiapertured wall 37. The sidewalls 36 are formed to be displaced slightly greater than 90° from the apertured wall 37, as an example the angle can be 93°. This causes the shadow mask sections to lightly press against the vane tips 28 and adds rigidity to the vane tips. The shadow mask sections 27 include a plurality of vertical locating tabs 38, which extend in the same plane as the apertured wall 37. The tabs 38 engage corresponding vertical locating slots in the vane tips 28 and insure the vertical positioning of the shadow mask section with respect to the vane tip.

Locking tabs 39 are arranged along the open ends of the sides 36. The locking tabs 39 lie in a plane substantially parallel to the plane of the vertical locating tabs 38 and engage corresponding locking slots in vane tips 28. The sides 36 do not extend completely to the end of the shadow mask member 27, thus allowing room for horizontal locating tabs 41 near the end of the section. The locating tabs 41 are very slightly narrower than the space between adjacent vane tips 28, thus prohibiting transverse movement of the shadow mask sections within the final shadow mask assembly. The horizontal locating tabs 41 are slightly wider than the remainder of surface 37. The locking tab slots and the locating tab slots in the vane tips 28 are longer than the corresponding locking tabs 39 and locating tabs 38 in the shadow mask section 27. Thus, a shadow mask section 27 can move with respect to its adjacent vane tips in a direction parallel to the vane tips, but not in the other two orthogonal directions. This allows thermal expansion along its long dimension while maintaining its position in the other two directions.

Figure 4:
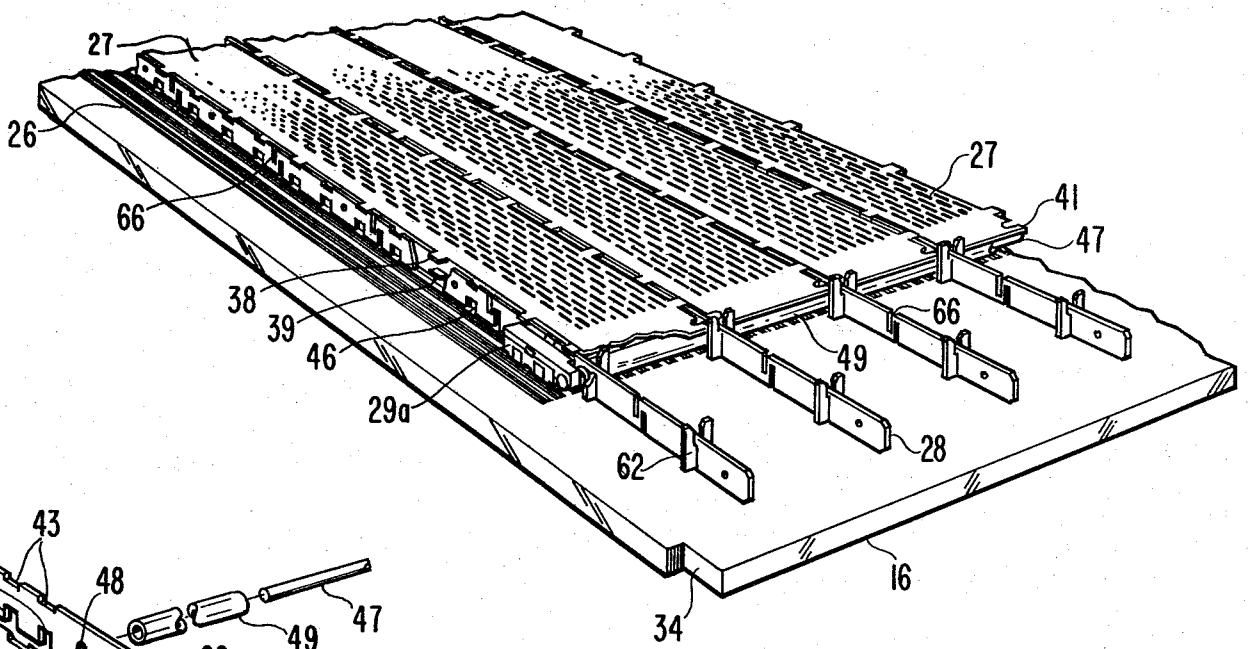
FIG. 4 is a perspective view partially broken away of a preferred embodiment.
Figure 5:
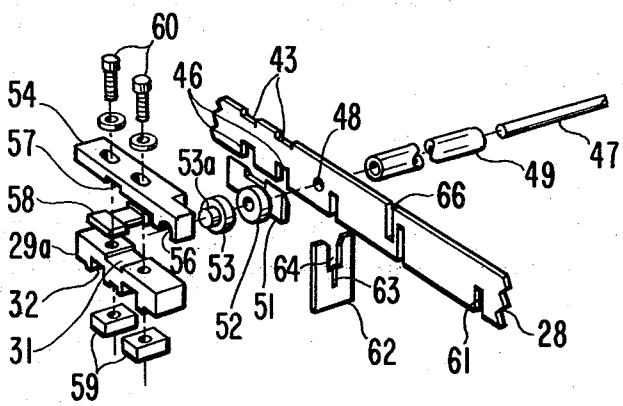
FIG. 5 is an exploded view of the locating blocks and the mounting arrangement for coupling the shadow mask assembly to the frontwall assembly.

FIGS. 4 and 5 show how the shadow mask sections 27 are combined with the vane tips 28 to form a shadow mask assembly. As shown in FIG. 5, the vane tip 28 includes vertical locating slots 43 which receive the vertical locating tabs 38. The locking tabs 39 are received in the locking slots 46 to vertically secure the shadow mask section to the vane tip. The horizontal locating tabs 41 fit snugly between the vane tips 28 and position the shadow mask sections 27 with respect to the vane tips 28. The engagement of the tabs 38 and 39, with the slots 43 and 46 respectively, maintain the vertical position of the shadow mask sections 27 with respect to the vane tips 28.

As shown in FIG. 4 a tie rod 47 passes through the tie rod holes 48 in the vane tips 28 to accurately space the vane tips 28. The shadow mask sections 27 are coupled to the vane tips 28 by the tabs 38 and 39. The tie rods 47 pass under the apertured side 37 and do not actually touch the shadow mask sections.

As shown in FIG. 5 tubular vane spacers 49 receive the tie rod 47. The spacers are positioned between the inside surfaces of adjacent vane tips 28 and are used to accurately space the vane tips 28 from each other. Accordingly, the only critical dimension of the vane spacers 49 is the overall length. The vane spacers are made of a material which has a lower coefficient of expansion than the frontwall 16. For example, glass spacers may be used with a soda lime glass frontplate. Thus, when the assembly is heated for bakeout, the spacer and metal vane tip sandwich expands less than the frontplate and no breakage occurs. During assembly the overall width of the shadow mask assembly can be controlled by monitoring the overall width of the assembly and choosing vane spacers of slightly increased or decreased length to change the width of the assembly.

The tie rod 47 also passes through an annular tie collar 52 and a tie rod insulator 53. The tie rod insulator 53 is blind bored and, therefore, the tie rod cannot pass completely through the insulator. The blind bores are sufficiently deep so that the tie rod can thermally expand within the bores to prevent deformation of the tie rods and shadow mask sections. The insulator 53 electrically separates the metallic shadow mask assembly from the metallic positioning clamp 54. After the desired number of shadow mask sections and vane tips are placed on the tie rod, the assembly is held together by collars 52 on both ends of the tie rods and setting the collars with set screws or other means. The assembly can then be handled as a single unit. Both ends of the shadow mask assembly are coupled by a tie rod, one tie rod extending between the two location blocks 29*a* and 29*c* and the other between the blocks 29*b* and 29*d*.

FIG. 5 is an exploded view of the tie rod coupling assembly by which the shadow mask assembly is coupled to the frontplate 16. The coupling assembly includes a positioning clamp 54 which includes a semi-circular notch 56. The notch 56 receives a narrow portion 53*a* of the insulator 53 to retain the vane tips on the frontwall 16. The positioning clamp 54 also contains a slot 57, which is positioned to coincide with the slot 31 in the locating block 29*a*. A spacer key 58 is received by the slots 31 and 57 and loosely positions the shim 51 so that it stays between the locating block 29*a* and the first vane tip. The positioning clamp 54 is held snugly in place on top of the locating block 29*a* by appropriate fastening means, such as screws 60 and clamping nuts 59, which are received by the slots 32.

The vane tip 28 also contains a vane guide slot 61 which is configured and dimensioned to receive a vane guide 62. The vane guide 62 includes a narrow rectangular slot 63 which mates with the slot 61 in the vane tip leaving vacant a substantially larger slot 64. The slot 64 is dimensioned to receive the vanes 19 so that the vane tips 28 are substantially laterally centered along the lengths of the vanes 19. Accordingly, a modular display device 10 (FIG. 1) can be assembled by coupling a finished frontplate, as shown in FIG. 4, to a completed backplate simply by engaging the vanes 19 with the slots 64 to guide the vanes of the backplate into position with respect to the vane tips.

The vane tips 28 also include expansion joints 66 spaced at appropriate intervals. These expansion joints allow for expansion and contraction of the vane tips due to thermal expansion without physically deforming the vane tips.

The completed faceplate assembly is illustrated in FIG. 4. After the desired number of shadow mask sections 27 and vane tips 28 are alternately coupled to the tie rod 47, with the vane spacers 49 between the sides of the vane tips, the assembly can be affixed to the frontplate 16 simply by mating the tie rod insulators 53 with the positioning clamp notches 56 and snugly fastening the positioning clamps 54 to the locating blocks *29a* through *29d*. Because the locating blocks *29a* through *29d* are approximately in the correct transverse positions, the shadow mask assembly will also be positioned with the same accuracy. The precise transverse position can be obtained by selecting the thicknesses of the shims 51 in accordance with the known deviations of the locating blocks from the exact desired positions with respect to the reference notches 34.

The assembly lends itself to automatic manufacturing techniques because the shadow mask assemblies can be made independently of the frontplate assemblies. Also, the frontplate assemblies can be provided with the phosphor screen and the locating blocks affixed thereto independently of the shadow mask assemblies. When a completed faceplate assembly is desired, a shadow mask assembly and a frontplate can be mated together and the exact positioning of the shadow mask assembly with respect to the location notches 34 can be obtained by selecting the shim 51 with the required thicknesses.

What is claimed is:

1. In a flat panel display device having an evacuated envelope with an individually assembled frontplate assembly and an individually assembled shadow mask assembly, an improvement comprising:

said shadow mask assembly including a plurality of channel shaped shadow mask sections, said mask sections including locking means;

a plurality of vane tips, including means for receiving at least one tie rod and including means for receiving said locking means;

a plurality of vane tip spacers configured to receive a tie rod;

at least one tie rod alternately receiving said vane tips and said vane tip spacers so that vane tip spacers are positioned between said vane tips and beneath said shadow mask sections;

means for retaining said vane tips on said tie rod;

said frontplate assembly including a frontplate having at least one precisely positioned locating notch;

a plurality of locating blocks affixed to the internal surface of said frontplate so that the precise position of said locating blocks with reference to said locating notches is known;

a plurality of clamp means for receiving said means for retaining and coupling said shadow mask assembly to said locating blocks.

2. The display device of claim 1 wherein said locating blocks are arranged in the proximity of the corners of said frontplate and are closely located in desired positions and wherein the locations of said locating blocks are precisely known with respect to said locating notches.

3. The display device of claim 2 wherein said tie rod is substantially perpendicular to the longitudinal dimension of said frontplate and said shadow mask sections so that said shadow mask sections are substantially parallel to the longitudinal dimension of said frontplate.

4. The display device of claim 3 wherein said vane tip spacers are hollow cylinders having precisely dimensioned lengths within a tolerance range to control the overall transverse dimension of said shadow mask assembly.

5. The display device of claim 4 further including a plurality of shims arranged between said locating blocks and said shadow mask assembly, said shims being selectively dimensioned to precisely locate said shadow mask assembly with respect to said locating notches.

6. The display device of claim 5 wherein said shadow mask sections include locating tabs, and said vane tips include locating slots, said locating tabs engaging said locating slots to accurately position said shadow mask sections with respect to said vane tips.

7. The display device of claim 6 wherein the cross sections of said channel shaped shadow mask sections are configured so that the sides are spread outwardly.

8. The display device of claim 7 wherein said means for retaining are dimensioned to permit thermal expansion of said tie rod.

9. The display device of claim 3 wherein the cross sections of said channel shaped shadow mask sections are configured so that the sides are spread outwardly.

10. The display device of claim 9 wherein said shadow mask sections include locating tabs, and said vane tips include locating slots, said locating tabs engaging said locating slots to accurately position said shadow mask sections with respect to said vane tips.

11. The display device of claim 10 further including a plurality of shims arranged between said locating blocks and said shadow mask assembly, said shims being selectively dimensioned to precisely locate said shadow mask assembly with respect to said locating notches.

12. The display device of claim 9 wherein said means for retaining are dimensioned to permit thermal expansion of said tie rod.

* * * * *